United States Patent [19]

Gelineau

[11] Patent Number: 4,831,237

[45] Date of Patent: May 16, 1989

[54] COOKING OVEN WITH SELF CLEANING PYROLYSIS SYSTEM

[75] Inventor: Jean M. Gelineau, Orleans, France

[73] Assignee: Compagnie Europeenne Pour L'Equipement Manager/CEPEM, Paris, France

[21] Appl. No.: 917,752

[22] Filed: Oct. 10, 1986

[30] Foreign Application Priority Data

Oct. 16, 1985 [FR] France ..... 85 15306

[51] Int. Cl.[4] ..... H05B 1/02

[52] U.S. Cl. ..... 219/398; 219/413; 126/21 R

[58] Field of Search ..... 126/299 R, 299 F, 21 R; 219/396–399, 412, 413

[56] References Cited

U.S. PATENT DOCUMENTS

| | | | |
|---|---|---|---|
| 3,428,435 | 2/1969 | Hurko et al. | 219/397 |
| 3,474,226 | 10/1969 | Kauraneu | 219/413 |
| 3,484,858 | 12/1969 | Jordan et al. | 219/413 |
| 4,238,670 | 12/1980 | Maitenaz | 219/413 |
| 4,292,501 | 9/1981 | Maitenaz | 219/413 |
| 4,302,661 | 11/1981 | Perry Jr. | 219/398 |
| 4,481,404 | 11/1984 | Thomas et al. | 219/398 |
| 4,493,976 | 1/1985 | Wilson | 219/398 |
| 4,535,226 | 8/1985 | Logel et al. | 219/398 |

FOREIGN PATENT DOCUMENTS

| | | |
|---|---|---|
| 1941338 | 2/1970 | Fed. Rep. of Germany . |
| 2365927 | 4/1978 | France . |

*Primary Examiner*—A. D. Pellinen
*Assistant Examiner*—Jeffery A. Gaffin
*Attorney, Agent, or Firm*—Pollock, VandeSande & Priddy

[57] ABSTRACT

The invention relates to an electric oven with self-cleaning pyrolytic system, includes a catalyst for smoke or fumes, at least one vault resistance and one sole resistance of standard values, wherein the oven further comprises means for powering at the beginning of a pyrolysis operation, simultaneously and exclusively the vault resistance and a part of the sole resistance, so that the power supplied by this part of the sole resistance is lower than the power supplied by the-vault resistance, and wherein the catalyst is produced from a material that allows its activation prior to the saturation of the oven by smoke or fumes, exclusively through the convection heat passing into a pipe housing the catalyst from the oven, and wherein means are provided for powering other resistances after the beginning of activation of the catalyst, in order to reach the pyrolysis temperature.

11 Claims, 1 Drawing Sheet

COOKING OVEN WITH SELF CLEANING PYROLYSIS SYSTEM

BACKGROUND OF THE INVENTION

1. Field of the Invention

The invention relates to a cooking oven to be cleaned through pyrolysis having a catalyst in the smoke evacuation circuit.

2. Summary of the Prior Art

Pyrolysis is a known operation for cleaning ovens that involves destroying, by heat, the grease deposits or stains that appear on the walls of an oven during cooking or reheating foods. The temperature of the oven must be 500° C. in order for the pyrolysis to be normally performed. This temperature is obtained by simultaneously operating at least the vault resistances and the sole resistances that are included in the oven.

However, the burning of greases or stains generates smoke which contains more or less harmful gases such as carbon monoxide or carbon dioxide. The gas content is higher when burning is incomplete.

The smoke generated by the burning of the greases is exhausted into the rooms where the oven is installed. It is thus necessary that the toxic gases be neutralized or oxidized when they escape from the oven so that their presence does not jeopardize the atmosphere of the room.

In order to perform this operation, it is known to dispose a palladium based oxide in the smoke evacuation circuit. However, this type of catalyst begins to operate, i.e. becomes effective, when it reaches a temperature of about 350° C. When the smoke evacuation pipe in which the catalyst is placed reaches 350° C., the oven has a considerably higher temperature, at which time the inner atmosphere is saturated by the smoke fumes.

In order to render the catalyst effective prior to the oven reaching such a saturation temperature, it is known to dispose a resistance for heating the catalyst, adjacent to the catalyst, in the smoke evacuation pipe.

Therefore, the catalyst is brought to a temperature of 350° C. and becomes effective before the temperature of the oven reaching the saturation temperature.

However, this structure presents certain drawbacks. During cooking, deposits of grease or stains also appear on the catalyst heating resistance. This resistance does not have sufficient power to reach a temperature high enough for these deposits to be destroyed. This means that their presence reduces the electric resistance of the filament, thus provoking an abnormal increase of the current flowing through it and of its temperature, and thus reducing its lifespan.

It is necessary to replace the catalyst heating resistance when its resistance is out of range. This operation is made difficult by the lack of accessibility of the catalyst heating resistance.

In order to overcome this drawback, ovens cleaned by pyrolysis are known in which the catalyst heating resistance does not come into contact with fumes.

However, the production of such devices is difficult since it is necessary to provide a special housing for the catalyst heating resistance in the smoke evacuation pipe.

SUMMARY OF THE INVENTION

The object of the invention is a pyrolytic oven with a catalyst that does not present these drawbacks, and which allows the pyrolysis operation to be performed without consuming supplementary energy with respect to the ovens of the prior art.

Cooking ovens generally comprise at least one heating resistance in the vault, in the upper part of the oven, and one resistance in the sole, in the lower part of the oven.

The sole resistance can be made of two parts which can be separately powered.

The smoke evacuation pipe is located at the upper part, close to the vault or top.

It will be observed that during a pyrolysis operation, the greatest proportion of smoke escapes from the sole, since it is in this region that the largest grease deposits and stains are formed due to spills or the like during cooking.

The invention is based on these observations and also has the aim of producing a pyrolysis catalyst oven wherein the activation of the catalyst or beginning of the operation takes place before the saturation of the oven by the fumes.

SUMMARY OF THE INVENTION

According to the invention, a pyrolytic electric oven provided with a catalyst to destroy smoke and fumes, comprising at least one standard vault heating resistance and one standard sole heating resistance. The inventive oven is characterized in that there are means for powering, at the beginning of the pyrolysis operation, simultaneously and exclusively the vault heating resistance and a part of the sole heating resistance, so that the power supplied by the latter is lower than the power supplied by the vault heating resistance. Furthermore the catalyst is a material that allows the operation to begin exclusively through the convection heat passing into the heating duct from the vault heating resistance and sole heating resistance part, prior to the oven being saturated by smoke and fumes.

According to another characteristic, the catalyst is a porous ceramic impregnated with platinum oxide in sufficient quantity for it to begin operation at a temperature lower than 300° C.

This temperature can easily be obtained in the pipe having the catalyst by utilizing standard vault and sole heating resistances. Therefore, it is not necessary to modify the design of the heating part of the oven and its chemical properties, for example by utilizing higher value resistances which require increased current consumption during cooking and pyrolysis.

Furthermore, when the actuating temperature of the catalyst has been obtained by exclusively powering the heating resistances intended for the cooking, under certain cooking conditions the catalyst can become effective if its temperature is higher than the activating temperature. In this case, if fumes appear during cooking, they will be free of their content of harmful gases.

According to another characteristic, when the catalyst has reached its activating temperature i.e. at the beginning of the catalyst operation, the power applied to the cooking zone is modified so that the pyrolysis temperature is reached in the oven.

In one embodiment, means are provided for detecting the fact that the catalyst has reached its activating temperature.

BRIEF DESCRIPTION OF THE DRAWINGS

Other advantages, objects and features of the invention will become apparent from the following description of several embodiments given with reference to the appended figures in which.

DETAILED DESCRIPTION OF THE PREFERRED EMBODIMENTS

Figure 1:
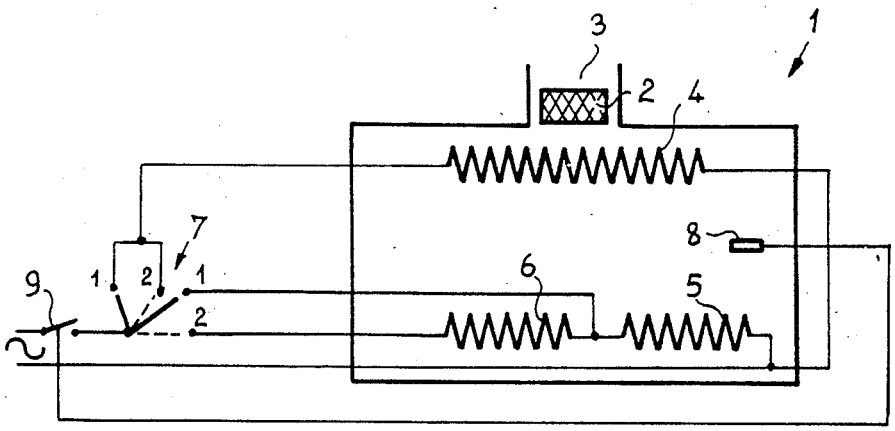
FIG. 1 is a wiring diagram of the oven.

FIG. 1 represents an oven 1 which is self cleaned through pyrolysis. The oven 1 includes catalyst 2 formed of a porous ceramic impregnated with platinum oxide, which begins operation at 250° C. As seen in FIG. 1 the catalyst 2 is placed in a smoke or fume evacuation pipe 3.

The oven further comprises at least one vault resistance 4 and one sole heating resistance in two parts 5, 6, each of which can be powered separately.

The sole resistance 5 is, for example, a peripheral part and the sole resistance 6 is for example the central part. It is in fact usual to produce ovens having such sole heating resistance design.

Means for powering the resistances are provided including a multi-position switch 7.

FIG. 1 shows only the contacts of the switch 7 that power the vault heating resistance 4 and the sole heating resistance 5, 6 so as to carry out the pyrolysis.

At the beginning of the pyrolysis operation, the vault resistance 4 and the peripheral sole resistance 5 are powered by putting the switch in position 1 as shown in full lines on the drawing.

The peripheral sole resistance 5 is generally less stained than the central sole resistance 6. This explains the choice of initially energizing the peripheral sole resistance 5.

The peripheral sole resistance 5 presents a lower power than that of the vault heating resistance 4.

Therefore the powering or energizing simultaneously of the vault heating resistance 4 and the peripheral sole resistance 5 allows temperature of the oven to rise without generating large quantities of smoke or fumes.

The vault resistance 4, having a power value higher than that of the peripheral sole resistance 5 has a larger effect on the catalyst 2.

On the contrary, the simultaneous powering or energizing of the peripheral sole resistance 5 favors convection of the heat towards the pipe 3, and prevents too large an amount of the energy supplied by the vault resistance 4 from heating the oven, and thus be lost for the heating of the pipe 3 in which the catalyst 2 is located.

It has been found that by using a standard vault resistance 4 whose power is approximately twice that of the peripheral sole resistance 5, i.e. $\frac{2}{3}$ of the power is used for the vault resistance 4 and $\frac{1}{3}$ for the sole resistance 5, activating the catalyst is obtained before excessive amounts of smoke or fumes are generated.

For example, by using a vault heating resistance 4 having a power of about 700 W and a peripheral sole heating resistance part 5 of about 450 W, it is possible to rapidly obtain a temperature at the center of the oven between 250° C. and 350° C. which allows the activation of the catalyst prior to saturation of the oven by smoke or fumes.

When the temperature of the oven rises sufficiently to activate or initiate the operation of the catalyst 2, the oven input power is modified in order to rapidly obtain a temperature of 500° C. in the oven. This input power modification is implemented energizing the central sole heating resistance 6 and any other possible resistances in the oven (position 2 of the switch 7).

FIG. 1 illustrates a thermostat 8 that allows an all or nothing control of the temperature at the center of the oven in order to maintain it at 500° C. To obtain this result, the thermostat 8 opens and closes a switch 9 that controls the general feed supply of the resistances of the oven.

This figure does not represent means for automatically switching the increased power once the catalyst 2 has been activated or after beginning of the catalyst operation.

However, the temperature of the catalyst is a function of the temperature of the center of the oven.

In one embodiment, the switch 7 can be associated with an inverter thermostat (not represented) that detects the temperature at the center of the oven and switches for increased power once the temperature of the center of the oven is such that the temperature of the pipe is high enough to initiate the operation of the catalyst.

As described hereinabove, the activation can occur for a temperature prevailing at the center of the oven between 250° and 350° C. The exact threshold limit temperature is determined during the first runs of the oven.

Another embodiment includes placing a thermostat in the pipe 3, in a position immediately adjacent to the catalyst 2. However, there exists the risk of the thermostat getting stained or fouled.

In another embodiment, the switch 7 is associated with a clock or timer which is, reset at zero when beginning a pyrolysis operation.

In fact, the rise in temperature of an oven is a function of time, and for a given type of oven, by knowing which resistances are in service, it is possible to determine by time measure when the oven reaches a given temperature.

It is therefore easy to determine the time necessary for activating the catalyst 2, and thus to associate a clock to the switch 7, by setting it in such a manner that said switch 7 changes from one position to another when the time necessary for activating the catalyst 2 has been exceeded.

As shown on all the known ovens, the switching over operation can be performed after 40 minutes of preheating.

It is therefore sufficient to set the clock for this period of time.

Figure 2:
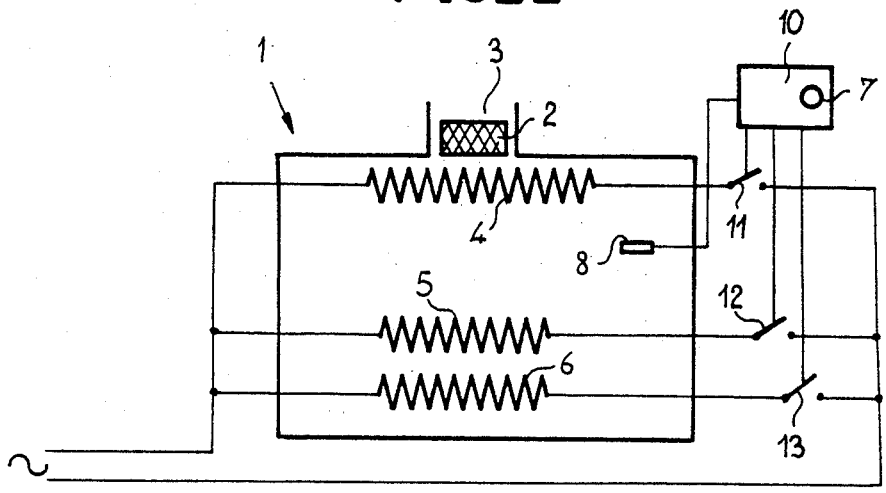
FIG. 2 represents an improved embodiment.

FIG. 2 represents an improved embodiment of the oven according to the invention.

The switch 7 is associated to an electronic device 10 which allows powering the desired heating resistances during the cooking and pyrolysis operations.

To achieve this result, the device 10 controls the opening or the closing of contacts 11, 12, 13 placed in the power circuit of the vault 4 and sole heating resistance 5, 6. In the example represented, the resistance can be connected in parallel. It is also possible to achieve series-parallel connections (see FIG. 1).

Additional resistances such as the grill resistances that are located in the oven and can also be controlled by the device 10.

The device is associated with thermostat 8 to provide control information.

Therefore, when the switch 7 is put into pyrolysis position, the device closes contacts 11 and 12 respectively connected to the vault resistance 4 and the peripheral sole resistance 5.

At the same time, the device 10 adjusts the threshold temperature for triggering the the thermostat at the temperature corresponding to the beginning of the activation of the catalyst.

When this temperature threshold is detected, the device is powered to bring the oven to 500° C. and to adjust a new temperature threshold.

In one embodiment, the device 10 includes a clock which switches contacts when the activating time is exceeded.

I claim:

1. An electric oven with a pyrolysis system including:

a catalyst for reducing emission of smoke or fumes, said catalyst located in an exhaust pipe and effective at operating temperatures below about 300 degrees C., vault and sole resistances, said sole resistance including a central sole resistance and a peripheral sole resistance, and means for powering said resistances to heat said oven for a pyrolysis operation, wherein said means for powering includes means for initially powering solely said vault resistance and said peripheral sole resistance so that said catalyst begins to operate solely from convection heat.

2. An oven as recited in claim 1 wherein:

said peripheral sole resistance has a power rating less than a power rating of said vault resistance, and wherein;

said means for powering further includes means for powering said central sole resistance in addition to said vault resistance and said peripheral sole resistance subsequent to initiation of operation of said catalyst to allow said oven to reach pyrolysis temperature.

3. An oven according to claim 2, wherein the vault resistance has a power rating corresponding substantially to twice a power rating of the peripheral sole resistance.

4. An oven according to claim 3, wherein the vault resistance has a power rating of about 700 watts.

5. An oven according to claim 3, wherein the peripheral sole resistance has a power rating of about 400 watts.

6. An oven according to claim 1, wherein the means for powering comprises a multi-position switch.

7. An oven as recited in claim 6 which further includes a clock, said multi-position switch connected to said clock to change closed contacts of said multi-position switch so that said central sole resistance is powered after a time necessary for catalyst operation has elapsed.

8. An oven according to claim 1, which further includes a thermostat and means responsive to the thermostat for adjusting the temperature in the oven and maintaining it at pyrolysis temperature after initiation of operation of the catalyst.

9. An oven according to claim 8, wherein the means responsive to the thermostat includes switching means for opening and/or closing electric circuits powering the oven resistances.

10. An oven according to claim 8, wherein the thermostat is coupled to electronic means for powering at least one of the heating resistances in order to maintain it at pyrolysis temperature by compensating for heat losses of the oven.

11. An oven as recited in claim 1 wherein said catalyst is a porous ceramic impregnated with platinum oxide.

* * * * *